US009139793B2

(12) United States Patent
Kawamura et al.

(10) Patent No.: US 9,139,793 B2
(45) Date of Patent: Sep. 22, 2015

(54) GREASE COMPOSITION, GREASE-PACKED BEARING, UNIVERSAL JOINT AND LINEAR MOTION DEVICE

(75) Inventors: Takayuki Kawamura, Mie (JP); Mitsunari Asao, Mie (JP)

(73) Assignee: NTN CORPORATION, Osaka (JP)

( * ) Notice: Subject to any disclaimer, the term of this patent is extended or adjusted under 35 U.S.C. 154(b) by 0 days.

(21) Appl. No.: 13/976,911

(22) PCT Filed: Dec. 16, 2011

(86) PCT No.: PCT/JP2011/079145

§ 371 (c)(1),
(2), (4) Date: Jun. 27, 2013

(87) PCT Pub. No.: WO2012/090722

PCT Pub. Date: Jul. 5, 2012

(65) Prior Publication Data

US 2013/0276563 A1 Oct. 24, 2013

(30) Foreign Application Priority Data

Dec. 29, 2010 (JP) ..... 2010-294495

(51) Int. Cl.
*C10M 141/08* (2006.01)
*C10M 141/06* (2006.01)
(Continued)

(52) U.S. Cl.
CPC ..... *C10M 133/18* (2013.01); *C10M 135/18* (2013.01); *C10M 2201/062* (2013.01);
(Continued)

(58) Field of Classification Search
CPC ..... C10M 133/18; C10M 135/18; C10M 2219/044; C10M 2217/0456; C10M 2207/122; C10M 2201/062; Y10T 74/18744; C10N 2230/70; C10N 2230/43; C10N 2230/40; C10N 2210/02; C10N 2210/01; C10N 2210/06
USPC ..... 508/108, 179, 364, 368
See application file for complete search history.

(56) References Cited

U.S. PATENT DOCUMENTS 4,648,985 A * 3/1987 Thorsell et al. ..... 508/364
5,002,674 A * 3/1991 Farng et al. ..... 508/428
(Continued)

FOREIGN PATENT DOCUMENTS

CN 1136074 A 11/1996
CN 1203260 A 12/1998
(Continued)

OTHER PUBLICATIONS

International Preliminary Report on Patentability Dated Jul. 10, 2013.
(Continued)

*Primary Examiner* — Pamela H Weiss
(74) *Attorney, Agent, or Firm* — Hedman & Costigan, P.C.; James V. Costigan; Kathleen A. Costigan

(57) ABSTRACT

The present invention provides a grease composition which contains a small amount (not more than 0.06 wt %) of molybdenum and yet is capable of achieving an excellent low friction property when mechanical parts in which the grease composition has been packed are operated under a severe sliding condition in which they are subjected to a high speed and a high contact pressure. The present invention also provides a bearing, a universal joint, and a linear motion device in which the grease composition of the present invention is packed. A grease composition (7) is packed inside a grease-packed bearing (1) in such a way that the grease composition (7) is applied to at least the circumference of each rolling element (4). The grease composition (7) contains base oil, a thickener, and an additive. The additive includes molybdenum dithiocarbamate and sodium dithiocarbamate.

16 Claims, 3 Drawing Sheets

(51) Int. Cl.
*C10M 135/18* (2006.01)
*C10M 133/18* (2006.01)

(52) U.S. Cl.
CPC . *C10M2203/1006* (2013.01); *C10M 2207/122* (2013.01); *C10M 2207/2805* (2013.01); *C10M 2215/1026* (2013.01); *C10M 2217/0456* (2013.01); *C10M 2219/044* (2013.01); *C10M 2219/068* (2013.01); *C10M 2227/066* (2013.01); *C10N 2210/01* (2013.01); *C10N 2210/02* (2013.01); *C10N 2210/06* (2013.01); *C10N 2230/06* (2013.01); *C10N 2230/40* (2013.01); *C10N 2230/43* (2013.01); *C10N 2230/70* (2013.01); *C10N 2240/02* (2013.01); *C10N 2240/046* (2013.01); *C10N 2250/10* (2013.01); *Y10T 74/18744* (2015.01)

(56) References Cited

U.S. PATENT DOCUMENTS

| | | | | |
|---|---|---|---|---|
| 5,494,608 | A | 2/1996 | Kamakura | |
| 7,278,332 | B2 * | 10/2007 | Nakatani et al. | 74/89.44 |
| 2005/0003970 | A1 * | 1/2005 | Ohmura et al. | 508/365 |
| 2009/0016652 | A1 * | 1/2009 | Endo et al. | 384/13 |

FOREIGN PATENT DOCUMENTS

| | | | |
|---|---|---|---|
| CN | 101432404 | A | 5/2009 |
| EP | 0 768 367 | A1 | 4/1997 |
| EP | 2003187 | A2 | 12/2008 |
| JP | 07-197072 | A | 8/1995 |
| JP | 08-188788 | A | 7/1996 |
| JP | 08-188790 | A | 7/1996 |
| JP | 09-003468 | A | 1/1997 |
| JP | 10-147791 | A | 2/1998 |
| JP | 2001-187891 | A | 7/2001 |
| JP | 3988897 | B | 7/2007 |
| JP | 2007-262300 | A | 10/2007 |
| JP | 4181771 | B | 9/2008 |
| JP | 2008-249078 | A | 10/2008 |
| KR | 10-0191904 | B1 | 6/1999 |
| KR | 10-2008-0109015 | A | 12/2008 |
| WO | 2007/114135 | A1 | 11/2007 |

OTHER PUBLICATIONS

International Search Report Dated Mar. 19, 2012.
Supplementary European Search Report dated May 27, 2014.

* cited by examiner

GREASE COMPOSITION, GREASE-PACKED BEARING, UNIVERSAL JOINT AND LINEAR MOTION DEVICE

TECHNICAL FIELD

The present invention relates to a grease composition; and a bearing, a universal joint, a ball screw, and a linear motion device in which the grease composition is packed.

BACKGROUND ART

In the industrial world, to allow a lubricant to have high performance, attempts of improving the lubricity of the lubricant by adding various additives thereto have been made. In the case where a bearing or the like is operated under a condition in which the bearing or the like is subjected to a high speed and a high contact pressure, a lubricating film of a grease composition packed in the bearing or the like is liable to be broken. As a result of the breakage of the lubricating film, metal-to-metal contact occurs to cause a problem that heat and frictional wear are increasingly generated. Therefore the grease composition is demanded to show an excellent lubricity when the bearing or the like is operated under a severe condition in which the bearing or the like is subjected to a high speed and a high contact pressure. Mechanical parts such as the bearing, the universal joint, the linear motion device, and the ball screw are operated under the severe condition in which they are subjected to the high speed and the high contact pressure. Thus there is the above-described demand for the grease composition used to lubricate the mechanical parts. To reduce friction when the mechanical parts are operated under the condition in which they are subjected to the high contact pressure, attempts of adding an extreme pressure agent such as an organometallic compound to the grease composition have been made.

The greases for a constant velocity joint which contain a molybdenum compound such as molybdenum dialkyldithiocarbamate (molybdenum dithiocarbamate) or molybdenum dithiophosphate as the organometallic compound are proposed (see patent documents 1 and 2). In order for the constant velocity joint to decreasingly generate vibrations, there is also proposed the grease for the constant velocity joint containing molybdenum dithiocarbamate soluble in base oil, which is combined with molybdenum dithiocarbamate insoluble in the base oil as an extreme pressure agent thereof (see patent document 3).

The grease not containing molybdenum disulfide and containing an organomolybdenum compound and Ca sulfonate is also proposed (see patent document 4). Further, to prevent deterioration of the quality and lubricating performance of the grease composition in using the rolling bearing under a severe condition in which the rolling bearing is subjected to a high temperature, a high load, and a high speed, there is proposed the grease for the rolling bearing containing a microcapsule in which the additive such as a dithiocarbamate is packed (see patent document 5).

PRIOR ART DOCUMENT

Patent Document

Patent document 1: Japanese Patent Application Laid-Open No. 07-197072

Patent document 2: Japanese Patent Application Laid-Open No. 10-147791

Patent document 3: U.S. Pat. No. 4,181,771

Patent document 4: U.S. Pat. No. 3,988,897

Patent document 5: Japanese Patent Application Laid-Open No. 2008-249078

SUMMARY OF THE INVENTION

Problems to be Solved by the Invention

In operating the mechanical parts such as the bearing, the universal joint, the linear motion device, and the ball screw under a severe condition in which they are subjected to a higher speed and a higher contact pressure in recent years than speeds and contact pressures to which they were subjected before, the conventional additives are insufficient in the performance thereof. Thus the conventional additives are demanded to have improved performance. The molybdenum compounds described in the above-described patent documents are substances regulated by PRTR (Pollutant Release and Transfer Register). A decrease in the amount of use of the molybdenum compound is desired from the standpoint of the protection of environment, and the use thereof is regarded as a problem.

In the case where a very small amount of molybdenum is used and in the case where the additive such as the dithiocarbamate (except molybdenum dithiocarbamate) is used singly, it is difficult to allow the grease composition to display a sufficiently low friction property when the mechanical parts in which the grease composition has been packed are operated in the severe condition in which they are subjected to the high speed and the high contact pressure. In view of the above-described situation, there is a desire for the development of the grease composition which contains a small amount of molybdenum and yet is excellent in its low friction property when the mechanical parts where the grease composition has been packed are operated in the condition in which they are subjected to the high speed and the high contact pressure.

The present invention has been made to deal with the above-described problems. Therefore it is an object of the present invention to provide a grease composition which contains a small amount of molybdenum (not more than 0.06 wt %) and yet is capable of achieving an excellent low friction property when mechanical parts where the grease composition has been packed are operated under a severe sliding condition in which they are subjected to a high speed and a high contact pressure. It is another object of the present invention to provide a bearing, a universal joint, and a linear motion device in which the grease composition of the present invention is packed.

Means for Solving the Problems

The grease composition of the present invention contains base oil, a thickener, and an additive, wherein the additive contains molybdenum dithiocarbamate (hereinafter referred to as MoDTC) and sodium dithiocarbamate (sodium is hereinafter referred to as Na); and the content of molybdenum contained in the whole weight of the grease composition is set to not more than 0.06 wt %.

The Na dithiocarbamate is Na dimethyldithiocarbamate, Na diethyldithiocarbamate or Na dibutyldithiocarbamate.

The content of the Na dithiocarbamate is set to one to seven parts by weight for 100 parts by weight which is a total of a weight of the base oil and that of the thickener.

The molybdenum dithiocarbamate is oil-soluble. The content of the oil-soluble molybdenum dithiocarbamate is set to 0.2 to one part by weight for 100 parts by weight which is the total of the weight of the base oil and that of the thickener.

The additive contains at least one compound selected from among calcium carbonate (calcium is hereinafter referred to as Ca), Na acetate, Ca acetate, barium sulfonate, and zinc sulfonate. The content of the compound is set to one to six parts by weight for 100 parts by weight which is the total of the weight of the base oil and that of the thickener.

The base oil contains not less than 50 wt % of highly purified oil or mineral oil as an essential component thereof for a whole weight thereof. The base oil contains ester oil or synthetic hydrocarbon oil. The content of sulfur contained in the highly purified oil is set to less than 0.1 wt %.

The thickener is a urea compound prepared by a reaction between a polyisocyanate component and a monoamine component. The monoamine component is at least one monoamine selected from among aliphatic monoamines and alicyclic monoamines.

The grease composition of the present invention is packed inside a grease-packed bearing of the present invention.

The grease composition of the present invention is packed inside a universal joint of the present invention.

The linear motion device of the present invention linearly moves along a guide member. The grease composition of the present invention is packed inside the linear motion device. The linear motion device has a screw axis, serving as a guide member, which has spiral thread grooves formed on an outer peripheral surface thereof; a ball screw nut, corresponding to the screw axis, which has spiral thread grooves formed on an inner peripheral surface thereof; and a plurality of balls interposed between both thread grooves. The grease composition is packed inside the linear motion device in such a way that the grease composition is applied to circumferences of the balls.

Effect of the Invention

Because the grease composition of the present invention contains a small amount of the MoDTC and the Na dithiocarbamate as its additive, the grease composition is capable of showing an excellent lubricity, and thus has an improved wear resistance and an improved low friction property even when the mechanical parts where the grease composition has been packed are operated under the severe condition in which they are subjected to the high speed and the high contact pressure, although the grease composition contains a small amount of molybdenum (not more than 0.06 wt %). In addition, by using the Ca carbonate, the Na acetate or the Ca acetate in combination with the MoDTC and the Na dithiocarbamate, it is possible to allow the grease composition to have the low friction property to a higher extent.

Because the base oil contains not less than 50 wt % of the highly purified oil or the mineral oil as its essential component for the whole weight thereof, it is possible to allow the grease composition to maintain its lubricity and produce it at a low cost. In addition, by using the urea compound as the thickener of the grease composition, the obtained grease composition is excellent in its heat resistance and durability and intervention in sliding portions of the mechanical parts and adhesiveness thereto.

Because the grease composition of the present invention is packed inside the bearing, universal joint, and linear motion device of the present invention, it is possible to allow sliding surfaces thereof to have a low coefficient of friction and thus restrain the sliding surfaces thereof from being worn, even though the above-described mechanical parts are operated under the condition in which they are subjected to the high speed and the high contact pressure. Further because the grease of the present invention packed inside the mechanical parts contains a small amount of the molybdenum (not more than 0.06 wt %), the grease is preferable from the standpoint of the protection of environment.

MODE FOR CARRYING OUT THE INVENTION

Figure 1:
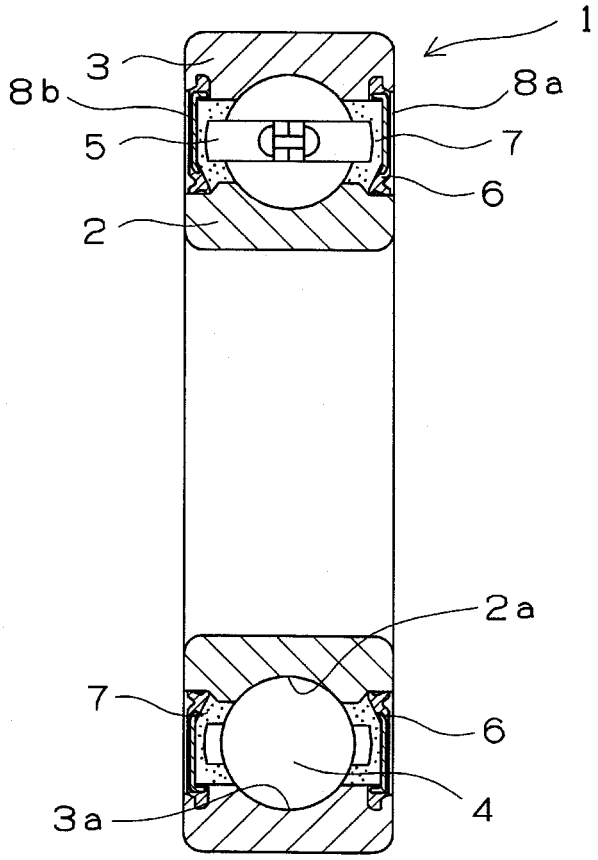
FIG. 1 is a sectional view showing a deep groove ball bearing as an example of a grease-packed bearing of the present invention.

The grease composition of the present invention is obtained by adding an additive to base grease consisting of base oil and a thickener. The additive includes (1) MoDTC and (2) Na dithiocarbamate such as Na diethyldithiocarbamate. (3) The content of molybdenum contained in the grease composition is set to not more than 0.06 wt %. By using the MoDTC and the Na dithiocarbamate of dithiocarbamates in combination as the additive to the grease composition, it is considered that the grease composition is capable of generating a molybdenum film on sliding surfaces of mechanical parts and has an improved wear resistance and an excellent low friction property, although the grease composition contains a small amount of the molybdenum.

As the MoDTC to be used in the present invention, molybdenum dialkyldithiocarbamates shown by an equation (1) shown below are exemplified. Oil-soluble MoDTC is preferable in the present invention. By using the oil-soluble MoDTC for the grease composition, the grease composition is excellent in its heat resistance and durability, does not pyrolyze, and has a high effect for enhancing its extreme pressure property, although the grease composition contains a small amount, namely, not more than 0.06 wt % of the molybdenum.

[Chemical Formula 1]

$$(R^1R^2N-\overset{\overset{\displaystyle S}{\|}}{C}-S)_2-Mo_2O_XS_Y \qquad (1)$$

(In the chemical formula 1, $R^1$ and $R^2$ denote alkyl groups whose carbon number is 1 to 24, preferably 3 to 18. X and Y are integers satisfying an equation of X+Y=4. X is 0 to 3. Y is 4 to 1.)

An operation described below is performed to check whether the oil-soluble MoDTC is preferable in the present invention. After 0.5 wt % of the MoDTC is added to the base oil to be used to compose the grease composition for the total of the weight of the MoDTC which has dissolved in the base oil and that of the base oil, the solution is stirred. Thereafter the solution set to 70° C. is left for 24 hours. In the case of the preferable MoDTC, an insoluble matter is not deposited when the solution is visually observed. In the case where the insoluble matter has been deposited in the base oil, the base oil does not become transparent, but the MoDTC has a colloidal state or a suspended state visually distinguishable. As the oil-soluble MoDTC commercially available, SAKURA-LUBE 100, SAKURA-LUBE 165, and SAKURA-LUBE 200 all produced by ADEKA CORPORATION are listed.

The content of molybdenum for the whole weight of the grease composition is set to not more than 0.06 wt %. The blending proportion of the MoDTC is so set as to satisfy the above-described content of the molybdenum.

It is preferable to set the blending proportion (content) of the oil-soluble MoDTC to 0.2 to 1 part by weight for 100 parts by weight of the base grease. When the blending proportion of the oil-soluble MoDTC is less than 0.2 parts by weight, there is a fear that the grease composition is not allowed to have a sufficiently low friction property in the case where the mechanical parts in which the grease composition has been packed are operated under a condition in which they are subjected to a high speed and a high contact pressure. When the blending proportion of the oil-soluble MoDTC exceeds one part by weight, there is a case in which the content of the molybdenum contained in the grease composition exceeds 0.06 wt % in dependence on the kind of the MoDTC. In this case, the grease composition is incapable of containing a small amount of the molybdenum. Although a small amount of solid MoDTC (SAKURA-LUBE 600 or the like produced by ADEKA CORPORATION) may be added to the base oil instead of the oil-soluble MoDTC, the solid MoDTC is inferior in its dispersibility.

The additive of the grease composition of the present invention includes the Na dithiocarbamate as its essential component in addition to the MoDTC. By using the Na dithiocarbamate in combination with the MoDTC as the additive of the grease composition, the grease composition contains a small amount (not more than 0.06 wt %) of the molybdenum and yet is capable of having an improved wear resistance and the excellent low friction property. As the Na dithiocarbamate, Na dialkyldithiocarbamates are preferable. Of the Na dialkyldithiocarbamates, Na dimethyldithiocarbamate, Na diethyldithiocarbamate, and Na dibutyldithiocarbamate are especially preferable because these Na dialkyldithiocarbamates are excellent in the extreme-pressure property thereof.

The blending proportion (content) of the Na dithiocarbamate is set to favorably one to seven parts by weight and especially favorably two to six parts by weight for 100 parts by weight of the base grease. In the case where the blending proportion of the Na dithiocarbamate is less than one part by weight, there is little improvement in the effectiveness in allowing the sliding surfaces of the mechanical parts to have the low friction property to a higher extent. In the case where the blending proportion of the Na dithiocarbamate exceeds seven parts by weight, the oil-soluble MoDTC is prevented from allowing the grease composition to have the excellent low friction property. Thus the grease composition is not allowed to have a sufficiently low friction property in the case where the mechanical parts are operated under a condition in which they are subjected to a low contact pressure.

It is preferable that the grease composition of the present invention also contains Ca carbonate, Ca acetate or Na acetate as its additive. The Ca carbonate, the Ca acetate, and the Na acetate may be added to the base grease in combination. The grease composition containing these compounds is more effective in allowing the sliding surfaces of the mechanical parts to have the low friction property to a higher extent. It is preferable to set the blending proportion (content) of these compounds to one to six parts by weight for 100 parts by weight of the base grease. In the case where these compounds are added to the base grease in combination, it is preferable to set the total of the weights of these compounds to the above-described range. In the case where the blending proportion of these compounds used in combination is less than one part by weight for 100 parts by weight of the base grease, the grease composition is effective to a low extent in allowing the sliding surfaces of the mechanical parts to have the low friction property to a higher extent. In the case where the blending proportion of these compounds used in combination is more than six parts by weight for 100 parts by weight of the base grease, the grease composition does not have a higher extent of effectiveness than the extent of the effectiveness to be obtained by the grease composition containing one to six parts by weight of these compounds used in combination for 100 parts by weight of the base grease in allowing the sliding surfaces of the mechanical parts to have the low friction property to a higher extent.

By using the Ca carbonate, the Ca acetate and/or the Na acetate in combination with the MoDTC and the Na dithiocarbamate which are the essential components of the grease composition of the present invention as the additive of the grease composition, it is possible to allow the sliding surfaces of the mechanical parts to have the excellent low friction property equivalently to conventional grease composition containing a usual amount (1 to 5 wt %) of molybdenum powders insoluble in oil when the mechanical parts are operated under the severe condition in which they are subjected to the high speed and the high contact pressure, although the grease composition of the present invention contains a small amount (not more than 0.06 wt %) of the molybdenum.

The grease composition of the present invention may contain known additives other than the above-described additives as necessary. As such additives, it is possible to list an antirust agent such as dinonyl naphthalene sulfonate and sorbitan ester; an antioxidant such as an amine-based compound and a phenol-based compound; a corrosion inhibitor such as sodium nitrite and sodium sebacate; a solid lubricant such as graphite and molybdenum disulfide; an oily agent such as fatty acid amide, fatty acid, amines, and oils and fats; and a viscosity index improver such as polymethacrylate and polystyrene. These additives can be used singly or in combination for the grease composition.

Of known additives, it is preferable that the grease composition contains barium sulfonate or zinc sulfonate as an additive thereof. The grease composition containing these compounds is capable of obtaining an effect similar to that to be obtained in the case where the grease composition contains the Ca carbonate or the like. As in the case of the Ca carbonate, the blending proportion (content) of these compounds is set to favorably one to six parts by weight and more favorably two to four parts by weight for 100 parts by weight of the base grease.

The base oil of the grease composition of the present invention is not limited to a specific kind, but it is possible to use base oil generally used in the field of grease. For example, it is possible to use highly purified oil, mineral oil, animal and vegetable oils, ester-based synthetic oil, synthetic hydrocarbon oil, phosphate ester oil, silicone oil, fluorine oil, and mixed oils of these oils.

In consideration of the lubricity and cost of the grease composition, of these oils, it is preferable to use base oil containing not less than 50 wt % of the highly purified oil or the mineral oil as an essential component thereof for the whole weight of the base grease. In the case where the highly purified oil or the mineral oil is used by mixing the highly purified oil or the mineral oil with other oils, it is preferable to use the highly purified oil or the mineral oil in combination with the synthetic hydrocarbon oil or the ester oil excellent in the low-temperature performance and high-temperature performance thereof. The base oil having a kinematic viscosity (in the case of mixed oil, the kinematic viscosity thereof) in a range of 66 to 100 $mm^2/s$ at 40° C. is especially preferable, because the base oil having the kinematic viscosity in the above-described range is excellent in its low-temperature performance and high-temperature performance.

The highly purified oil is prepared by subjecting slagwax obtained from residual oil in distillation under reduced pressure to catalytic hydropyrolysis and synthesizing the obtained substance. GTL oil synthesized by Fischer Tropsh method is also exemplified as the highly purified oil. The content rate of sulfur of the highly purified oil is set to favorably less than 0.1 wt % and more favorably less than 0.01 wt %. As the highly purified oil commercially available, Shell Hi-Vac Oils X46, X68 produced by Showa Shell Sekiyu K. K. are exemplified. As the mineral oil, spindle oil, refrigerating oil, turbine oil, machine oil, and dynamo oil are listed.

The thickener of the grease composition of the present invention is not limited to a specific one, but it is possible to use those generally used in the field of grease. For example, it is possible to use a soap thickener such as metal soap and composite metal soap; and a non-soap thickener such as Benton, silica gel, urea compounds, and urea.urethane compounds. As the metal soap, sodium soap, calcium soap, aluminum soap, and lithium soap are listed. As the urea compounds and the urea.urethane compounds, diurea compounds, triurea compounds, tetraurea compounds, other polyurea compounds, and diurethane compounds are listed. Of these thickeners, it is preferable to use the urea compounds because they are excellent in its heat resistance and durability, intervention in sliding portions of the mechanical parts, and adhesiveness to the sliding portions.

The urea compound is prepared by a reaction between a polyisocyanate component and a monoamine component. As the polyisocyanate component, phenylene diisocyanate, tolylene diisocyanate, diphenyl diisocyanate, diphenylmethane diisocyanate, octadecane diisocyanate, decane diisocyanate, and hexane diisocyanate are listed. As the monoamine component, it is possible to use aliphatic monoamines, alicyclic monoamines, and aromatic monoamines. As the aliphatic monoamines, hexylamine, octylamine, dodecylamine, hexadecylamine, octadecylamine, stearylamine, and oleylamine are listed. As the alicyclic monoamines, cyclohexylamine is exemplified. As the aromatic monoamine, aniline and p-toluidine are exemplified.

Of these urea compounds, it is especially preferable to use an aliphatic urea compound or an alicyclic urea compound containing aromatic diisocyanates used as the polyisocyanate component and the aliphatic monoamines and/or the alicyclic monoamines used as the monoamine component, because these compounds are especially excellent in their heat resistance and durability, intervention in the sliding portions of the mechanical parts, adhesiveness to the sliding portions.

By adding the thickener such as the urea compound to the base oil, the base grease to which the above-described additives are to be added is prepared. The base grease containing the urea compound as the thickener is produced by the reaction between the polyisocyanate component and the monoamine component.

The blending proportion of the thickener to be contained in 100 parts by weight of the base grease is set to one to four parts by weight and preferably three to 25 parts by weight. In the case where the content of the thickener is less than one part by weight, the thickener has a low thickening effect and thus it is difficult to obtain base grease having a desired performance. In the case where the content of the thickener exceeds 40 parts by weight, the obtained base grease is so hard that it is difficult to obtain a desired effect.

The grease composition of the present invention can be used as grease to be packed inside the mechanical parts such as the bearing, the universal joint, the linear motion device, and the ball screw which are operated under the severe condition in which they are subjected to the high speed and the high contact pressure. These mechanical parts are described below.

The grease-packed bearing of the present invention is described below with reference to FIG. 1. FIG. 1 is a sectional view of a deep groove ball bearing which is a rolling bearing. A grease-packed bearing 1 has an inner ring 2 having an inner ring rolling surface 2*a* on its outer peripheral surface, an outer ring 3 concentric with the inner ring 2 and having an outer ring rolling surface 3*a* on its inner peripheral surface, and a plurality of rolling elements 4 disposed between the inner ring rolling surface 2*a* and the outer ring rolling surface 3*a*. A cage 5 holds a plurality of the rolling elements 4. A sealing member 6 fixed to the outer ring 3 is disposed at openings 8*a* and 8*b* formed at both axial ends of each of the inner ring 2 and the outer ring 3. A grease composition 7 of the present invention is packed inside the bearing 1 in such a way that the grease composition 7 is applied to the circumference of each rolling element 4.

In addition to the above-described ball bearing, the grease composition of the present invention can be also packed in rolling bearings such as a cylindrical roller bearing, a tapered roller bearing, a self-aligning roller bearing, a needle-shaped roller bearing, a thrust cylindrical roller bearing, a thrust tapered roller bearing, a thrust needle-shaped roller bearing, and a thrust self-aligning roller bearing; and a sliding bearing.

Figure 2:
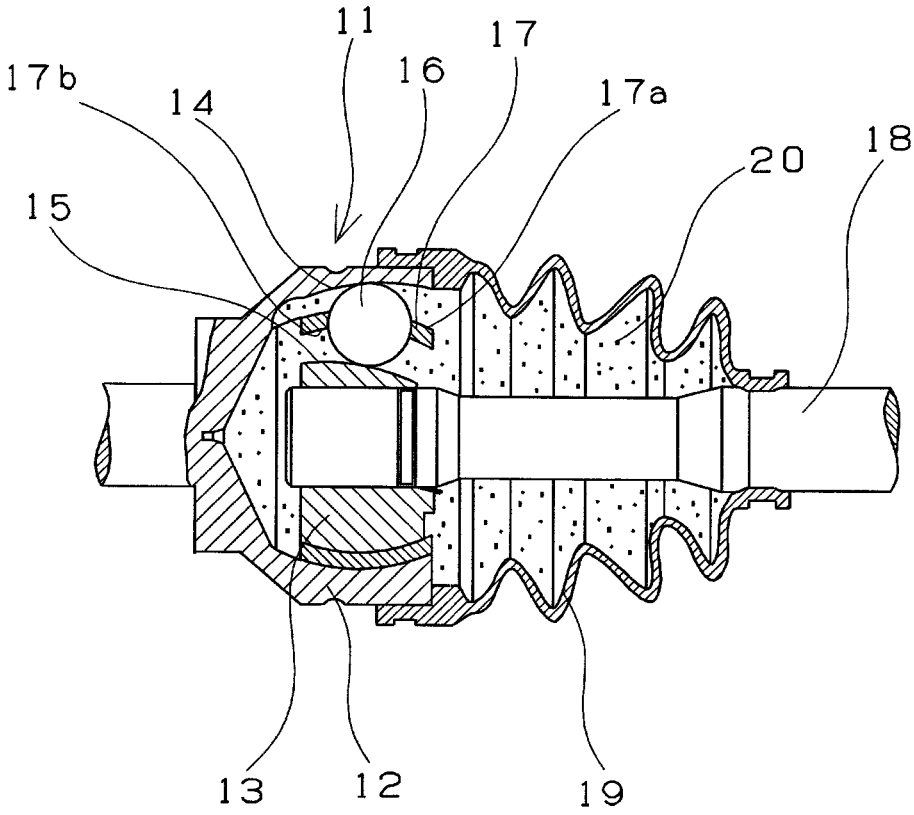
FIG. 2 is a sectional view showing a constant velocity joint as an example of the universal joint of the present invention.

The universal joint of the present invention is described below with reference to FIG. 2. FIG. 2 is a partly cutaway sectional view showing a Rzeppa type constant velocity joint as an example of the universal joint of the present invention. As shown in FIG. 2, in a constant velocity joint 11, six track grooves 14, 15 are axially and equiangularly formed on an inner surface of an outer member (or called an outer ring) 12 and an outer surface of a spherical inner member (or called an inner ring) 13. A cage 17 supports a torque transmission member (or called a ball) 16 incorporated between the track grooves 14, 15. The outer circumference of the cage 17 is formed as a spherical surface 17*a*. The inner circumference of the cage 17 is formed as a spherical surface 17*b* which fits on the outer circumference of the inner member 13. A boot 19 covers the outer circumference of the outer member 12 and that of a shaft 18. A grease composition 20 of the present invention is packed inside a space surrounded with the outer member 12, the inner member 13, the track grooves 14, 15, the torque transmission member 16, the cage 17, and the shaft 18.

Although the Rzeppa type constant velocity joint has been described as an example of the universal joint of the present invention, in addition to the Rzeppa type constant velocity joint, the grease composition of the present invention can be used as grease to be packed inside a fixed type constant velocity joint such as a bar field type; a slide type constant velocity joint such as a double off-set type, a cross groove type, and a tripod type; and non-constant velocity universal joint such as a cross joint.

Figure 3:
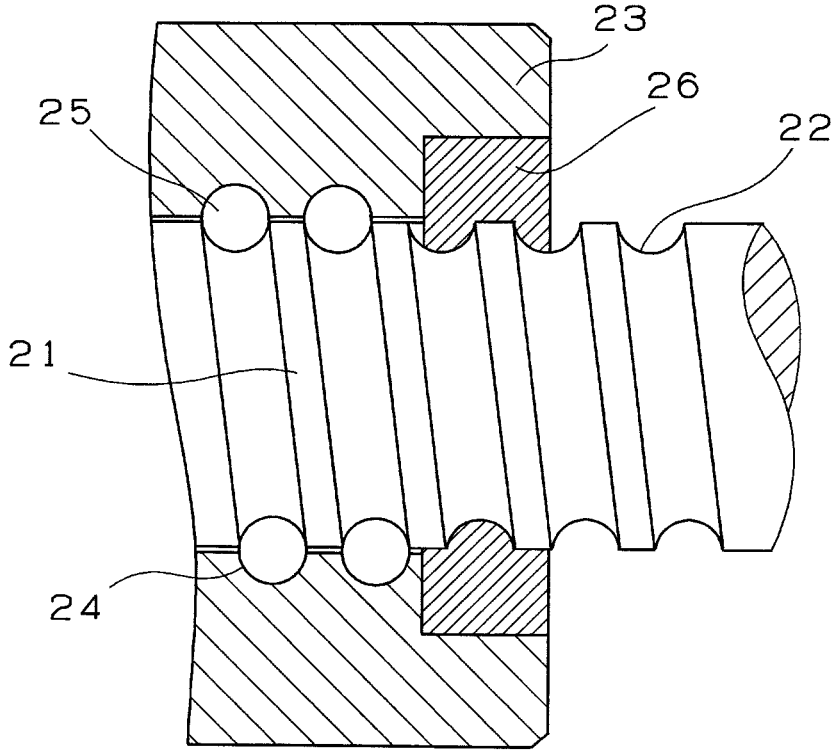
FIG. 3 is a sectional view showing a ball screw as an example of the linear motion device of the present invention.

A linear motion device of the present invention is described below with reference to FIG. 3. FIG. 3 is a sectional view showing a ball screw as an example of the linear motion device of the present invention. As shown in FIG. 3, in the ball screw of the present invention, a plurality of balls 25 is interposed between thread grooves 22 formed on an outer peripheral surface of a screw axis 21 serving as a guide member and thread grooves 24 formed on an inner peripheral surface of a ball nut 23. The rotational power of the screw axis 21 or that of the ball nut 23 is transmitted to the ball nut 23 (or the screw axis 21) through balls 25 to axially move the ball nut 23. The grease composition of the present invention is packed between the screw axis 21 and the ball nut 23 in such a way that the grease composition is applied to the circumferences of the balls 25. The grease composition is sealed with a sealing member 26 for the ball screw.

EXAMPLES

The present invention is further described below by way of examples and comparative examples, but the scope of the present invention is not limited thereby.

Examples 1 Through 29 and Comparative Examples 1 Through 18

The base grease of each of the examples 1 through 29 and comparative examples 1 through 18 was obtained by thickening the base oil with a diurea thickener (diurea compound prepared by reacting octylamine and cyclohexylamine with 4,4'-diphenylmethyl diisocyanate) at rates shown in tables 1 through 6. After additives shown in tables 1 through 6 were mixed with the base grease of each of the examples and the comparative examples, each mixture was treated with a three-stage roll mill. Thereafter the mixture was defoamed to obtain the grease composition of each of the examples and the comparative examples. The Mo content shown in the tables denotes the content (wt %) of molybdenum for the whole weight of the grease composition. Each of the obtained grease compositions was subjected to an SRV frictional wear test shown below to measure the friction coefficient thereof. Tables 1 through 6 show the results. Substances shown by 1) through 16) in tables 2 through 6 are identical to those shown in table 1.

<SRV Frictional Wear Test>

Test piece: Ball whose diameter was 10 mm (SUJ2)

Disk plate whose diameter was 24 mm×7.85 mm (SUJ2)

Evaluation Condition:

Maximum contact pressure in point contact: 1.45 GPa, 2.62 GPa

Frequency: 10 Hz

Amplitude: 1.2 mm

Period of time: 30 minutes

Test temperature: 40° C.

Measured item: average value of coefficients of friction (values which became constant within measured time period)

TABLE 1

| | Example | | | | | | | |
|---|---|---|---|---|---|---|---|---|
| | 1 | 2 | 3 | 4 | 5 | 6 | 7 | 8 |
| Mixing ratio (part by weight) | | | | | | | | |
| Base oil | | | | | | | | |
| Mineral oil[1)] | — | 92 | — | — | — | — | — | — |
| Mineral oil[2)] | — | — | 92 | — | — | — | — | — |
| Highly purified oil[3)] | 90 | — | — | 90 | 90 | 90 | 90 | 90 |
| Synthetic hydrocarbon oil[4)] | — | — | — | — | — | — | — | — |
| Ester oil[5)] | — | — | — | — | — | — | — | — |
| Thickener | | | | | | | | |
| Octylamine | 2.7 | 2.2 | 2.2 | 2.7 | 2.7 | 2.7 | 2.7 | 2.7 |
| Cyclohexylamine | 2.1 | 1.6 | 1.6 | 2.1 | 2.1 | 2.1 | 2.1 | 2.1 |
| MDI[6)] | 5.2 | 4.2 | 4.2 | 5.2 | 5.2 | 5.2 | 5.2 | 5.2 |
| Additive | | | | | | | | |
| Oil-soluble MoDTC[7)] | 0.5 | 0.5 | 0.5 | 0.2 | 1 | 0.5 | 0.5 | 0.5 |
| Powder of MoDTC[8)] | — | — | — | — | — | — | — | — |
| Na diethyldithiocarbamate[9)] | 5 | 5 | 5 | 5 | 5 | — | — | 1 |
| Na dimethyldithiocarbamate[10)] | — | — | — | — | — | 5 | — | — |
| Na dibuthyldithiocarbamate[11)] | — | — | — | — | — | — | 5 | — |
| Na acetate[12)] | — | — | — | — | — | — | — | — |
| Ca acetate[13)] | — | — | — | — | — | — | — | — |
| Ca carbonate[14)] | — | — | — | — | — | — | — | — |
| Barium sulfonate[15)] | — | — | — | — | — | — | — | — |
| Zinc sulfonate[16)] | — | — | — | — | — | — | — | — |
| Worked penetaration (JIS K2220) | No. 1 | No. 1 | No. 1 | No. 1 | No. 1 | No. 1 | No. 1 | No. 1 |
| Content of MO (wt %) | 0.03 | 0.03 | 0.03 | 0.01 | 0.06 | 0.03 | 0.03 | 0.03 |
| Coefficient of friction (1.45 Gpa) | 0.08 | 0.09 | 0.09 | 0.1 | 0.09 | 0.08 | 0.1 | 0.09 |
| Coefficient of friction (2.62 Gpa) | 0.05 | 0.05 | 0.05 | 0.06 | 0.06 | 0.06 | 0.06 | 0.06 |

[1)]Vitrea Oil (produced by Showa Shell Sekiyu K.K, 68 $mm^2$/s@40° C.)

[2)]Vitrea Oil (produced by Showa Shell Sekiyu K.K, 100 $mm^2$/s@40° C.)

[3)]Hi-Vac Oil X (produced by Showa Shell Sekiyu K.K, 68 $mm^2$/s@40° C.) 4) Durlasyn 170 (BP, 66 $mm^2$/s@40° C.)

[5)]H2362 (HATCO, 72 $mm^2$/s@40° C.)

[6)]4,5-diphenylmethane diisocyanate (produced by Nippon Polyurethane Industry Co., Ltd.)

[7)]SAKURA-LUBE 200 (produced by ADEKA CORPORATION)

[8)]SAKURA-LUBE 600(produced by ADEKA CORPORATION)

[9),12),13),14)]Reagent (produced by Wako Pure Chemical Industries, Ltd.)

[10)]Reagent (produced by Tokyo Chemical Industry Co., Ltd.)

[11)]Nocceler TP (produced by OUCHI SHINKO CHEMICAL INDUSTRIAL CO., Ltd.)

[15)]Petroleum-based neutral barium sulfonate SULFOL Ba-30N (produced by Matsumura Oil Co., Ltd.)

[16)]Zinc dinonylnaphthalenesulfonate NA-SUL ZS (produced by King Industries, Inc.)

TABLE 2

| | Example | | | | | | |
|---|---|---|---|---|---|---|---|
| | 9 | 10 | 11 | 12 | 13 | 14 | 15 |
| Mixing ratio (part by weight) | | | | | | | |
| Base oil | | | | | | | |
| Mineral oil[1)] | — | — | — | — | — | — | — |
| Mineral oil[2)] | — | — | — | — | — | — | — |
| Highly purified oil[3)] | 90 | 90 | 90 | 90 | 90 | 90 | 90 |
| Synthetic hydrocarbon oil[4)] | — | — | — | — | — | — | — |
| Ester oil[5)] | — | — | — | — | — | — | — |
| Thickener | | | | | | | |
| Octylamine | 2.7 | 2.7 | 2.7 | 2.7 | 2.7 | 2.7 | 2.7 |
| Cyclohexylamine | 2.1 | 2.1 | 2.1 | 2.1 | 2.1 | 2.1 | 2.1 |
| MDI[6)] | 5.2 | 5.2 | 5.2 | 5.2 | 5.2 | 5.2 | 5.2 |
| Additive | | | | | | | |
| Oil-soluble MoDTC[7)] | 0.5 | 0.5 | 0.5 | 0.5 | 0.5 | 0.5 | 0.5 |
| Powder of MoDTC[8)] | — | — | — | — | — | — | — |
| Na diethyldithiocarbamate[9)] | 2 | 7 | 5 | 5 | 5 | 5 | 5 |
| Na dimethyldithiocarbamate[10] | — | — | — | — | — | — | — |
| Na dibuthyldithiocarbamate[11)] | — | — | — | — | — | — | — |
| Na acetate[12)] | — | — | 1 | 2 | 5 | 6 | — |
| Ca acetate[13)] | — | — | — | — | — | — | 2 |
| Ca carbonate[14)] | — | — | — | — | — | — | — |
| Barium sulfonate[15)] | — | — | — | — | — | — | — |
| Zinc sulfonate[16)] | — | — | — | — | — | — | — |
| Worked penetaration (JIS K2220) | No. 1 | No. 1 | No. 1 | No. 1 | No. 1 | No. 1 | No. 1 |
| Content of MO (wt %) | 0.03 | 0.03 | 0.03 | 0.03 | 0.03 | 0.03 | 0.03 |
| Coefficient of friction (1.45 Gpa) | 0.08 | 0.09 | 0.08 | 0.07 | 0.07 | 0.09 | 0.07 |
| Coefficient of friction (2.62 Gpa) | 0.05 | 0.06 | 0.05 | 0.04 | 0.05 | 0.06 | 0.05 |

TABLE 3

| | Example | | | | | | |
|---|---|---|---|---|---|---|---|
| | 16 | 17 | 18 | 19 | 20 | 21 | 22 |
| Mixing ratio (part by weight) | | | | | | | |
| Base oil | | | | | | | |
| Mineral oil[1)] | — | — | — | — | — | — | — |
| Mineral oil[2)] | — | — | — | — | — | — | — |
| Highly purified oil[3)] | 90 | 90 | 90 | 90 | 90 | 45 | 72 |
| Synthetic hydrocarbon oil[4)] | — | — | — | — | — | 45 | 18 |
| Ester oil[5)] | — | — | — | — | — | — | — |
| Thickener | | | | | | | |
| Octylamine | 2.7 | 2.7 | 2.7 | 2.7 | 2.7 | 2.7 | 2.7 |
| Cyclohexylamine | 2.1 | 2.1 | 2.1 | 2.1 | 2.1 | 2.1 | 2.1 |
| MDI[6)] | 5.2 | 5.2 | 5.2 | 5.2 | 5.2 | 5.2 | 5.2 |
| Additive | | | | | | | |
| Oil-soluble MoDTC[7)] | 0.5 | 0.5 | 0.5 | 0.5 | — | 0.5 | 0.5 |
| Powder of MoDTC[8)] | — | — | — | — | 0.1 | — | — |
| Na diethyldithiocarbamate[9)] | 5 | 5 | 5 | 5 | 5 | 5 | 5 |
| Na dimethyldithiocarbamate[10)] | — | — | — | — | — | — | — |
| Na dibuthyldithiocarbamate[11)] | — | — | — | — | — | — | — |
| Na acetate[12)] | — | — | — | — | — | 2 | 2 |
| Ca acetate[13)] | — | — | — | — | — | — | — |
| Ca carbonate[14)] | 1 | 2 | 5 | 6 | — | — | — |
| Barium sulfonate[15)] | — | — | — | — | — | — | — |
| Zinc sulfonate[16)] | — | — | — | — | — | — | — |
| Worked penetaration (JIS K2220) | No. 1 | No. 1 | No. 1 | No. 1 | No. 1 | No. 1 | No. 1 |
| Content of MO (wt %) | 0.03 | 0.03 | 0.03 | 0.03 | 0.04 | 0.03 | 0.03 |
| Coefficient of friction (1.45 Gpa) | 0.09 | 0.07 | 0.07 | 0.09 | 0.09 | 0.06 | 0.07 |
| Coefficient of friction (2.62 Gpa) | 0.05 | 0.05 | 0.04 | 0.05 | 0.06 | 0.04 | 0.04 |

TABLE 4

| | Example | | | | | | |
|---|---|---|---|---|---|---|---|
| | 23 | 24 | 25 | 26 | 27 | 28 | 29 |
| Mixing ratio (part by weight) | | | | | | | |
| Base oil | | | | | | | |
| Mineral oil[1)] | — | — | — | — | — | — | — |
| Mineral oil[2)] | — | — | — | — | — | — | — |
| Highly purified oil[3)] | 46 | 73 | 90 | 90 | 90 | 90 | 90 |
| Synthetic hydrocarbon oil[4)] | — | — | — | — | — | — | — |
| Ester oil[5)] | 46 | 19 | — | — | — | — | — |
| Thickener | | | | | | | |
| Octylamine | 2.2 | 2.2 | 2.7 | 2.7 | 2.7 | 2.7 | 2.7 |
| Cyclohexylamine | 1.6 | 1.6 | 2.1 | 2.1 | 2.1 | 2.1 | 2.1 |
| MDI[6)] | 4.2 | 4.2 | 5.2 | 5.2 | 5.2 | 5.2 | 5.2 |
| Additive | | | | | | | |
| Oil-soluble MoDTC[7)] | 0.5 | 0.5 | 0.5 | 0.5 | 1 | 1 | 1 |
| Powder of MoDTC[8)] | — | — | — | — | — | — | — |
| Na diethyldithiocarbamate[9)] | 5 | 5 | 5 | 5 | 1 | 1 | 2 |
| Na dimethyldithiocarbamate[10)] | — | — | — | — | — | — | — |
| Na dibuthyldithiocarbamate[11)] | — | — | — | — | — | — | — |
| Na acetate[12)] | 2 | 2 | — | — | — | — | — |
| Ca acetate[13)] | — | — | — | — | — | — | — |
| Ca carbonate[14)] | — | — | — | — | — | — | — |
| Barium sulfonate[15)] | — | — | 2 | — | — | — | — |
| Zinc sulfonate[16)] | — | — | — | 2 | 1 | 2 | 4 |
| Worked penetaration (JIS K2220) | No. 1 | No. 1 | No. 1 | No. 1 | No. 1 | No. 1 | No. 1 |
| Content of MO (wt %) | 0.03 | 0.03 | 0.03 | 0.03 | 0.06 | 0.06 | 0.06 |
| Coefficient of friction (1.45 Gpa) | 0.07 | 0.07 | 0.07 | 0.07 | 0.06 | 0.06 | 0.06 |
| Coefficient of friction (2.62 Gpa) | 0.05 | 0.04 | 0.04 | 0.03 | 0.02 | 0.02 | 0.03 |

TABLE 5

| | Comparative example | | | | | | | | |
|---|---|---|---|---|---|---|---|---|---|
| | 1 | 2 | 3 | 4 | 5 | 6 | 7 | 8 | 9 |
| Mixing ratio (part by weight) | | | | | | | | | |
| Base oil | | | | | | | | | |
| Mineral oil[1)] | — | 92 | — | — | — | — | — | — | — |
| Mineral oil[2)] | — | — | 92 | — | — | — | — | — | — |
| Highly purified oil[3)] | 90 | — | — | 90 | 90 | 90 | 90 | 90 | 45 |
| Synthetic hydrocarbon oil[4)] | — | — | — | — | — | — | — | — | 45 |
| Ester oil[5)] | — | — | — | — | — | — | — | — | — |
| Thickener | | | | | | | | | |
| Octylamine | 2.7 | 2.2 | 2.2 | 2.7 | 2.7 | 2.7 | 2.7 | 2.7 | 2.7 |
| Cyclohexylamine | 2.1 | 1.6 | 1.6 | 2.1 | 2.1 | 2.1 | 2.1 | 2.1 | 2.1 |
| MDI[6)] | 5.2 | 4.2 | 4.2 | 5.2 | 5.2 | 5.2 | 5.2 | 5.2 | 5.2 |
| Additive | | | | | | | | | |
| Oil-soluble MoDTC[7)] | — | — | — | 0.5 | 1 | 1.6 | — | — | — |
| Powder of MoDTC[8)] | — | — | — | — | — | — | 1 | 2 | — |
| Na diethyldithiocarbamate[9)] | — | — | — | — | — | — | — | — | — |
| Na dimethyldithiocarbamate[10)] | — | — | — | — | — | — | — | — | — |
| Na dibuthyldithiocarbamate[11)] | — | — | — | — | — | — | — | — | — |
| Na acetate[12)] | — | — | — | — | — | — | — | — | — |
| Ca acetate[13)] | — | — | — | — | — | — | — | — | — |
| Ca carbonate[14)] | — | — | — | — | — | — | — | — | — |
| Barium sulfonate[15)] | — | — | — | — | — | — | — | — | — |
| Zinc sulfonate[16)] | — | — | — | — | — | — | — | — | — |
| Worked penetaration (JIS K2220) | No. 1 | No. 1 | No. 1 | No. 1 | No. 1 | No. 1 | No. 1 | No. 1 | No. 1 |
| Content of MO (wt %) | 0 | 0 | 0 | 0.03 | 0.06 | 0.1 | 0.35 | 0.7 | 0 |
| Coefficient of friction (1.45 Gpa) | 0.14 | 0.13 | 0.13 | 0.12 | 0.11 | 0.1 | 0.09 | 0.08 | 0.14 |
| Coefficient of friction (2.62 Gpa) | 0.13 | 0.11 | 0.11 | 0.1 | 0.09 | 0.08 | 0.07 | 0.04 | 0.12 |

TABLE 6

| | Comparative example | | | | | | | | |
|---|---|---|---|---|---|---|---|---|---|
| | 10 | 11 | 12 | 13 | 14 | 15 | 16 | 17 | 18 |
| Mixing ratio (part by weight) | | | | | | | | | |
| Base oil | | | | | | | | | |
| Mineral oil[1)] | — | — | — | — | — | — | — | — | — |
| Mineral oil[2)] | — | — | — | — | — | — | — | — | 92 |
| Highly purified oil[3)] | 72 | 46 | 73 | 90 | 90 | 90 | 90 | 90 | — |
| Synthetic hydrocarbon oil[4)] | 18 | — | — | — | — | — | — | — | — |
| Ester oil[5)] | — | 46 | 19 | — | — | — | — | — | — |
| Thickener | | | | | | | | | |
| Octylamine | 2.7 | 2.2 | 2.2 | 2.7 | 2.7 | 2.7 | 2.7 | 2.7 | 2.2 |
| Cyclohexylamine | 2.1 | 1.6 | 1.6 | 2.1 | 2.1 | 2.1 | 2.1 | 2.1 | 1.6 |
| MDI[6)] | 5.2 | 4.2 | 4.2 | 5.2 | 5.2 | 5.2 | 5.2 | 5.2 | 4.2 |
| Additive | | | | | | | | | |
| Oil-soluble MoDTC[7)] | — | — | — | — | — | — | — | — | — |
| Powder of MoDTC[8)] | — | — | — | — | — | — | — | — | — |
| Na diethyldithiocarbamate[9)] | — | — | — | 2 | 5 | 10 | — | — | 5 |
| Na dimethyldithiocarbamate[10)] | — | — | — | — | — | — | 5 | — | — |
| Na dibuthyldithiocarbamate[11)] | — | — | — | — | — | — | — | 5 | — |
| Na acetate[12)] | — | — | — | — | — | — | — | — | — |
| Ca acetate[13)] | — | — | — | — | — | — | — | — | — |
| Ca carbonate[14)] | — | — | — | — | — | — | — | — | — |
| Barium sulfonate[15)] | — | — | — | — | — | — | — | — | — |
| Zinc sulfonate[16)] | — | — | — | — | — | — | — | — | — |
| Worked penetaration (JIS K2220) | No. 1 | No. 1 | No. 1 | No. 1 | No. 1 | No. 1 | No. 1 | No. 1 | No. 1 |
| Content of MO (wt %) | 0 | 0 | 0 | 0 | 0 | 0 | 0 | 0 | 0 |
| Coefficient of friction (1.45 Gpa) | 0.14 | 0.14 | 0.14 | 0.13 | 0.13 | 0.13 | 0.13 | 0.14 | 0.14 |
| Coefficient of friction (2.62 Gpa) | 0.13 | 0.13 | 0.12 | 0.11 | 0.1 | 0.1 | 0.1 | 0.11 | 0.11 |

Tables 1 through 4 indicate that the grease composition of each example is capable of having an excellent low friction property owing to the use of the oil-soluble MoDTC and the Na dithiocarbamate as the additive of the grease composition, although the grease composition contains a small amount (not more than 0.06 wt %) of molybdenum. Tables 1 through 4 also indicate that owing to the use of the Ca carbonate, the Ca acetate and/or the Na acetate in combination with the MoDTC and the Na dithiocarbamate, it is possible to allow the grease composition to have the low friction property to a higher extent.

INDUSTRIAL APPLICABILITY

The grease composition of the present invention contains a small amount (not more than 0.06 wt %) of the molybdenum and yet has an excellent lubricity even when mechanical parts in which the grease composition has been packed are operated under the severe condition in which mechanical parts are subjected to the high speed and the high contact pressure. Therefore the grease composition can be preferably utilized as lubricating grease for a bearing, a universal joint, a linear motion device, and a ball screw which are operated under the condition in which they are subjected to the high speed and the high contact pressure.

EXPLANATION OF REFERENCE NUMERALS AND SYMBOLS

1: Grease-packed bearing
2: Inner ring
3: Outer ring
4: Rolling element
5: Cage
6: Sealing member
7: Grease composition
8*a*, 8*b*: Opening
11: Constant velocity joint
12: Outer member (Outer ring)
13: Inner member (Inner ring)
14, 15: Track groove
16: Torque transmission member (Ball)
17: Cage
18: Shaft
19: Boot
20: Grease composition
21: Screw axis
22: Thread groove
23: Ball nut
24: Thread groove
25: Ball
26: Sealing member

The invention claimed is:

1. A grease composition comprising base oil, a thickener, and an additive, wherein said additive contains molybdenum dithiocarbamate and sodium dithiocarbamate;

wherein said sodium dithiocarbamate is sodium dimethyldithiocarbamate, sodium diethyldithiocarbamate or sodium dibutyldithiocarbamate; and a content of molybdenum for a whole weight of said grease composition is set to not more than 0.06 wt %.

2. A grease composition according to claim 1, wherein a content of said sodium dithiocarbamate is set to one to seven parts by weight for 100 parts by weight which is a total of a weight of said base oil and that said thickener.

3. A grease composition according to claim 1, wherein said molybdenum dithiocarbamate is oil-soluble.

4. A grease composition according to claim 3, wherein a content of said oil-soluble molybdenum dithiocarbamate is set to 0.2 to 1 part by weight for 100 parts by weight which is a total of a weight of said base oil and that of said thickener.

5. A grease composition according to claim 3, wherein a content of said sodium dithiocarbamate is set to one to seven parts by weight for 100 parts by weight which is a total of a weight of said base oil and that of said thickener; and a content of said oil-soluble molybdenum dithiocarbamate is set to 0.2 to 1 part by weight for 100 parts by weight which is a total of a weight of said base oil and that of said thickener.

6. A grease composition according to claim 1, wherein said additive contains at least one compound selected from among calcium carbonate, sodium acetate, calcium acetate, barium sulfonate, and zinc sulfonate.

7. A grease composition according to claim 6, wherein a content of said compound is set to one to six parts by weight for 100 parts by weight which is a total of a weight of said base oil and that of said thickener.

8. A grease composition according to claim 1, wherein said base oil contains not less than 50 wt % of highly purified oil or mineral oil as an essential component thereof for a whole weight thereof.

9. A grease composition according to claim 8, wherein said base oil contains ester oil or synthetic hydrocarbon oil.

10. A grease composition according to claim 8, wherein a content of sulfur contained in said highly purified oil is set to less than 0.1 wt %.

11. A grease composition according to claim 1, wherein said thickener is a urea compound prepared by a reaction between a polyisocyanate component and a monoamine component.

12. A grease composition according to claim 11, wherein said monoamine component is at least one monoamine selected from among aliphatic monoamines and alicyclic monoamines.

13. A grease-packed bearing in which a grease composition is packed, wherein said grease composition is as claimed in claim 1.

14. A universal joint in which a grease composition is packed, wherein said grease composition is as claimed in claim 1.

15. A linear motion device which linearly moves along a guide member and in which a grease composition is packed, wherein said grease composition is as claimed in claim 1.

16. A linear motion device according to claim 15, comprising a screw axis, serving as a guide member, which has spiral thread grooves formed on an outer peripheral surface thereof; a ball screw nut, corresponding to said screw axis, which has spiral thread grooves formed on an inner peripheral surface thereof; and a plurality of balls interposed between said both thread grooves; and said grease composition is packed inside said linear motion device in such a way that said grease composition is applied to circumferences of said balls.

* * * * *